United States Patent [19]

Sibilia et al.

[11] 4,091,855

[45] May 30, 1978

[54] PROCESS FOR IMPROVING THE AMMONOLYTIC STABILITY OF POLYESTER TEXTILE YARN

[75] Inventors: John P. Sibilia, Livingston; Bernard Harlow Vrooman, Morristown, both of N.J.

[73] Assignee: Allied Chemical Corporation, Morris Township, N.J.

[21] Appl. No.: 735,308

[22] Filed: Oct. 26, 1976

[51] Int. Cl.[2] ..... D02G 3/48

[52] U.S. Cl. ..... 152/359; 57/140 R; 57/157 R; 204/165; 250/325

[58] Field of Search ..... 57/156, 157 R, 140 R; 204/165; 250/324–325; 152/356, 359

[56] References Cited

U.S. PATENT DOCUMENTS

| | | | |
|---|---|---|---|
| 3,377,262 | 4/1968 | Karickhoff et al. | 204/165 |
| 3,967,118 | 6/1976 | Sternberg | 250/325 |

*Primary Examiner*—Richard C. Queisser
*Assistant Examiner*—Charles Gorenstein
*Attorney, Agent, or Firm*—Robert J. North; Robert A. Harman

[57] ABSTRACT

A process is described for improving the ammonolytic stability of polyester textile yarn without substantial loss of its tensile strength which comprises exposing separated fibers of the yarn to corona discharge for a total of about 0.01 to 3 seconds at a speed of at least 100 feet per minute and then reforming the yarn. A cord made from this yarn is described, as well as a tire produced by bonding the cord to rubber.

12 Claims, No Drawings

PROCESS FOR IMPROVING THE AMMONOLYTIC STABILITY OF POLYESTER TEXTILE YARN

BACKGROUND

1. Field of the Invention

This invention relates to the improvement of the ammonolytic stability of polyester textile yarn by short term corona discharge treatment at high processing speeds.

2. Brief Description of the Prior Art

Polyester textile cord used in tires suffers from degradation due to the presence of various organic amines normally present in the rubber which are used as curing accelerators. The effect of an organic amine coming into contact with the polyester material is to accelerate the aging process leading to degradation of the polyester polymer chain and, thus, to a loss in the tensile strength of the fiber and subsequent shorter life for the tire. It is known in the art that esters in general are subject to ammonolysis under partial or totally anhydrous conditions, as disclosed in A. R. Day et al., JACS, Vol. 71, p. 1245 (1949), which is essentially the environment that polyester cord experiences within a tire.

Prior art methods have long been known in the film industry for increasing the adhesion of film and improvement of film surface properties by exposing them to an atmosphere of ionizing radiation.

Prior art methods are also known for treating synthetic textile fibers by exposing them to ionizing radiation and electrical discharge in a gas plasma to improve dye receptivity, as described in Belgium Pat. No. 653,113 (Eicken), and also for improving the adhesion of textile fiber cord in tires, where electrical discharge treatment is coupled with an after treatment of a resorcinol-formaldehyde-latex, as described in U.S. Pat. No. 3,477,902 (Tomasino, et al.) and Lawton, J. Appl. Pol. Sci., Vol. 18, p. 1557 (1974).

Electrical discharge treatment of fibers has been described using a rotating arc discharge mechanism which restrains the fiber from lateral displacement to improve the surface properties, as described in British Pat. No. 1,300,088 (Imperial Chemical Industries Ltd.).

Corona discharge treatment of fibers is also known to improve surface properties with respect to adhesion and surface appearance, as exemplified in Japanese Patent 7,010,797 (Asahi Chem. Ind. Co. Ltd.), U.S. Pat. No. 3,817,701 (Thorsen), and Japanese Kokai No. 9,035,692 (Kuraray Co. Ltd.).

However, none of the prior art references teaches the improvement of polyester textile material with respect to resistance to attack by ammonia or organic amines, e.g. ammonolytic stability. Also, prior art processes are mainly concerned with the improvement of adhesion through the application of ionized gaseous atmospheres by electrical discharge which invariably results in a decrease in the tensile strength of the polyester fiber since relatively long exposure times are necessary for significant improvements in polyester fiber adhesion. Further, prior art processes are not adaptable into an overall continuous process for producing polyester yarn which requires rapid processing speeds of at least 100 feet per minute, nor do any of such processes teach the formation of a polyester yarn in which the majority of the individual fibers have improved ammonolytic stability, thus producing an inherently more stable yarn as opposed to one in which the yarn bundle or cord made from the yarn is merely surface treated.

It is an object of this invention to produce polyester yarn possessing improved ammonolytic stability without substantial loss of its tensile strength.

It is also an object of this invention to produce a polyester yarn possessing improved ammonolytic stability at a processing speed which can readily be incorporated into a continuous commercial process for producing polyester yarn requiring very high speeds.

It is a further object to produce a tire cord comprised of polyester yarn possessing improved ammonolytic stability.

It is also a further object to provide a tire comprised of the tire cord produced by the process of this invention.

These and further objects of the invention will become apparent from the disclosure contained herein.

SUMMARY OF THE INVENTION

In accordance with this invention, there is provided a process for improving the ammonolytic stability of polyester textile yarn without substantial loss of its tensile strength which comprises:

(a) separating the fibers of the yarn being processed at a speed of at least 100 feet per minute;

(b) exposing the fibers to a zone of corona discharge for a total of about 0.01 to 3 seconds while passing the fibers through the discharge zone at the aforesaid speed; and (c) collecting the fibers at the aforesaid speed to reform the yarn.

Typically, the fibers are exposed to corona discharge of an input wattage of about 100 to 200 watts and frequency of about 400 to 500 KHz for a period of about 0.01 to 3 seconds.

The yarn produced by this process may be made into cord, which, in turn, may be bonded to rubber to produce a tire.

DETAILED DESCRIPTION

The advantages the instant invention are embodied in the fact that the ammonolytic stability of polyester textile yarn can be significantly improved during the high speed processing of the polyester yarn without substantial loss of its tensile strength. In addition, by treating the majority of fibers that comprise the yarn, not only does the surface of the yarn bundle, but also the fibers comprising the yarn interior, have improved ammonolytic stability, thereby producing a yarn having better ammonolytic stability than prior art yarns.

The improvement of the ammonolytic stability of the polyester yarn is accomplished by a corona discharge treatment of short duration at high processing speeds. The input power settings or the applied frequency used to produce the corona discharge are not critical variables, as any conventional types of corona discharge units may be employed to give the desired effect of increased ammonolytic stability. The choice of input power settings, applied frequency, and type of electrode and electrode geometry should be chosen such that the corona is in the form of a uniform glow over a fairly broad electrode area since sparking or arcing does result in fiber damage when contacted directly with the fiber surface. In general, an input wattage of 100 to 200 watts and an applied frequency of 400 to 500 kHz is sufficient to produce a satisfactory corona discharge. The choice of variables to achieve a suitable corona discharge with a given corona discharge unit or apparatus however, will be obvious to one skilled in the art.

The corona treament as disclosed in this invention is carried out at atmospheric conditions, and under normal humidity conditions. In general, higher humidity conditions produce a slight increase in ammonolytic stability with other factors being equal. If desired, the corona discharge treatment can be conducted within a partially enclosed apparatus wherein the percent relative humidity is controlled.

The prior art, for example as discussed in the Lawton reference, supra, teaches that the improvement of adhesion of polyester cord by low temperature gas plasmas is relatively insensitive to the power level of the discharge and to the total exposure time. It has been found that improvement in the ammonolytic stability of polyester yarn without substantial decrease in tensile strength is also not dependent upon the power levels of the discharge, but in contrast is surprisingly dependent upon the exposure times of corona discharge.

More specifically, it has been found that the ammonolytic stability of polyester fibers can be increased without substantial decrease in tensile strength by subjecting the fibers to a corona discharge, preferably under atmospheric conditions for about 0.01 to 3 seconds. For polyester yarn that is to be used in tire cord, e.g. polyethylene terephthalate, exposure times of about 0.03 to 1 second are generally preferred.

The test for ammonolytic stability is carried out by placing the yarn in an autoclave in an environment of dry ammonia gas which is fed into the autoclave at a flow rate of about 30 to 40 ml./min. at a constant temperature of 150° C. for 4 hours. The tensile strength of the treated yarn is determined on an Instron Tester and compared to the original tensile strength before corona discharge. The results are expressed as percent breaking strength retained, % BSR, of the yarn. This test for ammonolytic stability is commonly accepted in the industry as displaying a good correlation with the actual behavior and degree of aging of the polyester cord that is actually experienced under normal conditions of use in a polyester containing tire.

Short term exposure of polyester fiber to corona discharge for about 0.01 to 3 seconds produces a distinct improvement in the ability of the polyester fiber to withstand attack by ammonia, as evidenced by its larger overall percent breaking strength retained, whereas, exposure times longer than 3 seconds lead to a substantial decrease in the tensile strength.

In use of the present process the tensile strength of the yarn is not substantially decreased from its original value. Up to 5 percent decrease in the original tensile strength due to the corona discharge treatment, however, can be tolerated. It is preferred to subject the polyester yarn to a corona discharge treatment such that only a 0 to 3 percent decrease in the original tensile strength is experienced.

The process of this invention allows the corona treatment of polyester yarn at processing speeds which are generally above 100 ft/min. The preferred range of processing speeds is 500–2000 ft/min, which is in the range of the normal operating speeds during which polyester yarn is generally commercially processed. The ability to achieve improved ammonolytic stability of polyethylene terephthalate yarn at high processing speeds while separating the fibers of the yarn is a significant advantage over prior art methods which are usually concerned only with the improvement of the adhesion of bulk fabrics at very slow processing speeds, usually substantially below 100 ft per minute.

The separation of fibers within the yarn prior to corona treatment, which is an integral part of this invention can be accomplished in a number of ways depending upon the particular corona discharge apparatus which is being utilized. One common method is to use an idler roll tilted at an angle such that the yarn when passing over the idler roll is separated substantially into its component fibers, for example, as decribed in British Pat. No. 694,789 (1953), which then passes over an insulated electrode which is situated in the corona discharge zone. Other techniques are also available such as directing a stream of air at the yarn as it passes over the idler roll in which the pressure of the air will force the fibers apart before treatment, for example, as described in U.S. Pat. No. 3,535,745 (1970), or the use of a high speed comb over which the yarn passes, which is constructed in such a manner to obviate fiber breakage.

Improvement in the ammonolytic stability of the yarn can be accomplished by a relatively small separation of the individual fibers even as low as 5 percent before application of the corona discharge. However, the greater degree of separation of fibers, the more effective result is obtained.

In general, it is preferred to separate at least about 25 percent of the total fibers in the yarns. It is particularly preferred to separate at least about 50 percent of the total fibers in the yarn. If the degree of separation of fibers is below 25 percent, say down to about 5 percent, because of apparatus design, the process can be modified such that multiple passes of the separated yarn are made through the zone of corona discharge to yield equivalent results.

Other techniques that can be utilized in design of apparatus such that separation of yarn fibers is maximized are the use of more than one corona discharge zone, use of more than one insulated electrode in a zone and use of wide electrodes to increase the width of the corona discharge through which the separated fibers are passed. Combination of these techniques to maximize the efficiency of fiber surface exposure within the prescribed time limits will be obvious to one skilled in the art.

Washing or scouring the yarn with a suitable solvent to remove the yarn finish such as carbon tetrachloride, trichloroethylene, hexane, cyclohexane, etc., leads to slightly improved results with respect to ammonolytic stability compared to unwashed samples, but is optional. The washing removes fiber finish which is applied to the yarn to improve transport and processing properties to the yarn, and exposes more fiber surface area to corona treatment.

Preheating the yarn at temperatures of 100° C. and above prior to corona treatment also produces slightly improved results with respect to increased ammonolytic stability. The preheating treatment can also be used in combination with the washing treatment which together will provide a significant increase in the ammonolytic stability of the treated yarn. The demands of the high speed equipment used in the process will generally dictate which of these methods can be utilized. If a combination of these methods are employed, it is preferred to wash the yarn prior to corona treatment by passing the yarn through a bath of trichloroethylene or carbon tetrachloride or other suitable solvent and then through a drying oven to remove traces of solvent for about 5 to 10 seconds at a temperature of about 100° to 150° C.

The yarn which is produced by the process of this invention is easily made into a cord which can be used for a variety of purposes, particularly for use in tire cord.

The following examples are intended for illustrative purposes only and are not to be construed as limitations on the scope of the invention.

EXAMPLE 1

Polyethylene terephthalate yarn of 1338 denier comprised of 192 filaments and having an ultimate tensile strength of 8.59 g./d. (grams per denier) is driven through a corona discharge zone by a variable speed Godet unit consisting of two 6¼ inch diameter drive rollers and two 1 inch diameter idlers. The drive rollers are covered with approximately 0.1 inch of insulation (polyethylene terephthalate sheet, rubber or other suitable insulating material) and one or more electrodes are positioned about ⅛ inch above each of the insulated drive rolls. Each electrode consists of 4 aluminum bars, ¼ inch × ⅜ inch × 4 inch mounted on an insulated holder with ⅛ inch between bars. Each electrode produces a corona discharge approximately 2½ inch wide. The insulation on the drive rollers is used to provide a uniform discharge between the electrode and the roll surface. The yarn is passed over the Godet rolls and through the ⅛ inch electrode - Godet roll gap. The yarn is taken up with a Leesona Model 959 takeup unit having a variable speed and constant tension. The yarn is separated into its individual fibers on the idler roll and exposed to a corona discharge produced by a Lepel Generator, Model H.F. S.G.-2 of 450 kHz, 2.8 amps, 100 watts at a speed of 375 feet per minute, while passing through the corona discharge on the insulated roll. The number of passes which are at least two through each zone constitutes a total exposure time of 0.3 second. The yarn is reformed on the idler arm, collected, and twisted into 3 ply cord. The resulting cord is subjected to the ammonolytic stability test set forth above. The percent breaking strength retained of the treated yarn is 64.8 versus 53.8 for a non-corona treated yarn.

EXAMPLE 2

Using the equipment of Example 1, polyethylene terephthalate yarn of 1328 denier and ultimate breaking strength of 8.80 g./d. is washed with carbon tetrachloride to remove finish, heated, then separated into individual fibers and exposed to a corona discharge of 450 kHz, 2.8 amps, 100 watts for a total of 0.06 second at a speed of 750 feet per minute and then reformed into yarn. The treated yarn is then twisted into 3 ply cord and subjected to the ammonolytic stability test set forth above. The percent breaking strength retained is 69.6 compared to 60.0 of a non-corona treated carbon tetrachloride washed yarn.

EXAMPLE 3

Using the equipment of Example 1, polyethylene terephthalate yarn composed of 1300 denier and 192 filaments is washed with carbon tetrachloride and exposed for 0.06 seconds to a corona discharge of 100 watts and 2.8 amps at a speed of 125 feet per minute. The yarn is then made into a fabric by drum-winding and then subjected to an in-compound aging test which is conducted as follows: the fabric is combined with a high amine content rubber stock which is used to make a 6 inch by 6 inch pad of rubber such that the stock now contains two layers of the particular fabric; the rubber is then cured and the specimen aged for various times at 260° F. (127° C.); the specimen is then stripped and the cords removed and the retained breaking strength (percent BSR of the cords is measured). This test gives a measure of ammonolysis resistance of the polyethylene terephthalate cord in the rubber environment. Following are the results of the test:

| Sample | Corona Treatment Time (sec.) | Original Breaking Strength in Pounds | % Breaking Strength Retained Aging Times at 260° F. 2 hours | 4 hours | 6 hours | 8 hours |
|---|---|---|---|---|---|---|
| Control | — | 55 | 86 | 64 | 67 | 58 |
| $CCl_4$ washed sample | .06 | 54 | 100 | 80 | 73 | 69 |

The results indicate that the washed corona-treated yarn gives good results in the in-compound aging test versus non-corona-treated yarn which tends to provide a longer tire life as experienced by the yarn in a polyester-containing tire in which the rubber contains various organic amines.

We claim:

1. A process for improving the ammonolytic stability of polyester textile yarn without substantial loss of its tensile strength which comprises:

(a) separating fibers of the yarn being processed at a speed of at least about 100 feet per minute;

(b) exposing the fibers to a zone of corona discharge for a total of about 0.01 to 3 seconds while passing the fibers through the discharge zone at the aforesaid speed; and (c) collecting the fibers at the aforesaid speed to reform the yarn.

2. The process of claim 1 wherein the time of exposure to corona discharge is about 0.03 to 1 second.

3. The process of claim 1 wherein the corona discharge is conducted at an input wattage of about 100 to 200 watts and an applied frequency of about 400 to 500 kHz.

4. The process of claim 1 wherein the fibers are passed through the zone of corona discharge two or more times.

5. The process of claim 1 wherein as least about 25% of the fibers in the yarn are separated.

6. The process of claim 1 wherein at least about 50% of the fibers in the yarn are separated.

7. The process of claim 1 wherein the speed of the yarn is about 500 to 2000 feet per minute.

8. The process of claim 1 wherein the yarn is about 1000 to 1500 gram denier and is composed of about 50 to 300 individual fibers.

9. The process of claim 2 wherein the polyester textile yarn is polyethylene terephthalate.

10. The process of claim 1 wherein the polyester textile yarn is washed with a solvent to remove yarn finish before corona treatment.

11. A polyester tire cord comprised of the yarn produced by the process of claim 1.

12. A tire comprised of the polyester tire cord of claim 11 bonded to rubber.

* * * * *